US005936585A

United States Patent [19]

Hall

[11] Patent Number: 5,936,585

[45] **Date of Patent: *Aug. 10, 1999**

[54] VEHICLE WINDOW GLASS ANTENNA ARRANGEMENT

[75] Inventor: Scott Wayne Hall, Ypsilanti, Mich.

[73] Assignee: Ford Motor Company, Dearborn, Mich.

[ * ] Notice: This patent is subject to a terminal disclaimer.

[21] Appl. No.: 08/813,553

[22] Filed: Mar. 7, 1997

Related U.S. Application Data

[62] Division of application No. 08/379,409, Jan. 27, 1995, Pat. No. 5,640,167.

[51] Int. Cl.[6] ..... H01Q 1/32

[52] U.S. Cl. ..... 343/713

[58] Field of Search ..... 343/713, 704; H01Q 1/32

[56] References Cited

U.S. PATENT DOCUMENTS

| | | | |
|---|---|---|---|
| 3,728,732 | 4/1973 | Igarashi | 343/713 |
| 4,155,090 | 5/1979 | Kuroyanagi et al. | 343/713 |
| 4,260,989 | 4/1981 | Ishii et al. | 343/704 |
| 4,608,570 | 8/1986 | Inaba et al. | 343/704 |
| 4,954,797 | 9/1990 | Shinnai et al. | 343/704 |
| 5,017,933 | 5/1991 | Sakurai et al. | 343/704 |
| 5,029,308 | 7/1991 | Lindenmeier et al. | 343/704 |
| 5,083,134 | 1/1992 | Saitou et al. | 343/713 |
| 5,083,135 | 1/1992 | Nagy et al. | 343/713 |
| 5,097,270 | 3/1992 | Lindenmeier et al. | 343/704 |
| 5,101,212 | 3/1992 | Shinnai et al. | 343/713 |
| 5,119,106 | 6/1992 | Murakami | 343/713 |
| 5,178,722 | 1/1993 | Hoshino | 156/630 |
| 5,185,612 | 2/1993 | Tsukada et al. | 343/713 |
| 5,229,780 | 7/1993 | Hirotsu et al. | 343/713 |
| 5,239,303 | 8/1993 | Hirotsu et al. | 343/713 |
| 5,581,264 | 12/1996 | Tabata et al. | 343/713 |
| 5,610,619 | 3/1997 | Zafar | 343/713 |
| 5,640,167 | 6/1997 | Hall | 343/713 |

FOREIGN PATENT DOCUMENTS

| | | | |
|---|---|---|---|
| 2050236 | 7/1969 | France . | |
| 2405561 | 10/1977 | France . | |
| 33 41 616 A1 | 5/1984 | Germany . | |
| 3534572 | 4/1986 | Germany | H01Q 1/32 |
| 43 23 239 A1 | 1/1995 | Germany . | |
| 415105 | 2/1946 | Italy . | |
| 56-24802 | 3/1981 | Japan . | |
| 56-42401 | 4/1981 | Japan . | |
| 61-121601 | 6/1986 | Japan . | |
| 403255705 | 11/1991 | Japan | H01Q 1/32 |
| 2232331 | 12/1990 | United Kingdom . | |

*Primary Examiner*—Don Wong
*Assistant Examiner*—Hoang Nguyen
*Attorney, Agent, or Firm*—Mark L. Mollon; Roger L. May

[57] ABSTRACT

An FM signal antenna for window glass mounting in a motor vehicle includes an elongated conductor formed as a ladder to form a series of openings along its length. Preferably, the ladder is constructed of a pair of parallel conductors and cross member conductor segments coupled across the parallel connector. The cross member conductors are spaced from each other a distance substantially less than the wave length of the signals to be received. In addition, the antenna includes a raised feed point positioned along the length of the conductor. The conductor has a length substantially greater than the window area so that a fold is formed in the conductor, and an extended portion of the conductor overlapping from the fold is preferably aligned with and conductively independent of the feed point. In addition, the antenna is mounted above a heater grid comprising a plurality of transverse conductors extending between common potential conductors at either end of the grid. Preferably, equipotential line conductors extend across intermediate portions of the grid, and an equipotential line conductor is aligned with the feed point of the FM antenna.

20 Claims, 2 Drawing Sheets

VEHICLE WINDOW GLASS ANTENNA ARRANGEMENT

CROSS-REFERENCE TO RELATED APPLICATION

This application is a divisional application of U.S. patent application Ser. No. 08/379,409, filed Jan. 27, 1995, U.S. Pat. No. 5,640,167 and entitled "VEHICLE WINDOW GLASS ANTENNA ARRANGEMENT".

FIELD OF THE PRESENT INVENTION

The present invention relates generally to radio antennas for radio signal reception in a motor vehicle and, more particularly, to concealed, conformal or nonobstructive FM antenna structures with improved gain alignments of the antenna conductors.

BACKGROUND ART

Motor vehicles often use monopole antenna structures, such as the telescopically extended whip antenna, to provide an acceptable level of reception of radio signals in a moving automobile. However, the extension or protrusion of such structures from the vehicle body, in order to effectively receive the signal, exposes the antenna to abuse or inadvertent contact with debris during travel, induces wind noise and must be modified with complex and expensive retraction gear in order to protect the antenna when not in use. Moreover, retractable antennas mechanisms require substantial storage space and raise substantial packaging problems.

Concealed or conformal antenna structures such as those embedded in window lites of a motor vehicle, have been installed in order to overcome the problems discussed above. However, such antennas have had difficulty in meeting the performance standards of the conventional monopole aerial antenna. Substantial efforts have been undertaken and continue to be invested to improve radio reception using such antennas. Because numerous parts of the vehicle body, for example conductive panels made of sheet metal, and numerous systems including electrical circuits throughout the vehicle, can interfere with the reception of electromagnetic radio waves to be received by the antennas. Moreover, particular alignments of concealed conductors often provide a limited range or direction of reception, and thus find only limited usefulness in motor vehicle applications.

In addition, while it is known that the diameter of the antenna can be increased in order to improve the gain characteristics of the antenna across a larger bandwidth, the increased breadth of the conductor covers a larger portion of the window lite in which it may be mounted. Accordingly, antennas that are structured to improve performance according to conventional principles of antenna structure theory are quite unsuitable for concealing or obstructing the window lites in motor vehicles.

It has also been known to use dipole antennas. However, since dipoles are resonant type structures, the bandwidth of signals that they can receive is relatively low. Nevertheless, while it is known to make the conductor of the dipole antenna thicker to increase bandwidth and lower VSWR (voltage standing wave ratio), thickening of the antenna adversely affects the ability to conceal the antenna. As a result, limited success has been attained with the conventional changes of length and thickness of antenna conductors. In addition, changes in thickness are not an attractive option on window lites. Accordingly, the gain of previously known concealed window lite FM antennas has been limited, particularly at the ends of the bandwidth of the FM broadcast spectrum.

SUMMARY OF THE PRESENT INVENTION

The present invention overcomes the above-mentioned disadvantages by providing a perforated conductor in combination with alignment of the antenna that improve the gain of an FM antenna over a wide bandwidth. A feed point for cable connection with the antenna conductor is positioned intermediate the ends of the conductor to adjust the impedance of the antenna, and may be raised above straight line segments adjacent the feed point. One end of the antenna conductor is folded to increase the length of the conductor applied to the window lite and the fold preferably includes a segment of the antenna conductor aligned to correspond with a vehicle body panel edge. Furthermore, an extended conductor segment from the fold may be aligned with the feed point and raised above the straight line segments of the conductor.

In addition, the antenna alignment may be defined in relation to a heater grid having an equipotential line conductor aligned with the feed point of the FM antenna.

In the preferred embodiment, the antenna conductor comprises a ladder structure. As used in this disclosure, the ladder structure may be used to refer to a series of adjacent openings formed in an elongated conductor where continuous edges are separated by the openings. The preferred embodiment employs elongated parallel conductors and a plurality of cross member conductor segments connected across the parallel conductors at a plurality of spaced positions along the length of conductor. Preferably, the spacing between the cross members is a small fraction of a wavelength for the desired frequency range to be received by the antenna, preferably in the range of less than 0.01 wavelength for the highest frequency in the desired bandwidth.

In addition, the ladder conductor preferably includes a feed point positioned along the length of the conductor at a point governed by the impedance of the antenna formed by the conductor such that there is a proper impedance match with the receiver. The feed point governs the location of equipotential line conductors on a heater grid printed on the window lite, as one of the equipotential line conductors will be aligned to the feed point of the FM antenna. The equipotential line conductor lies intermediate common potential conductors secured at the ends of a plurality of transversely aligned heating grid conductors, and a second equipotential line conductor is positioned symmetrically to the first equipotential line conductor with respect to the center of the heating grid between the common potential conductors.

As a result, the present invention provides improved gain across a broader bandwidth than in previously known window lite FM signal antennas. In addition, the present invention provides a combination of heater grid structure and ladder conductor that improves performance of the antenna by feed point alignment with equipotential line conductors connected across the heater grid.

In addition, the present invention provides an elongated, folded monopole construction that improves performance by raising the feed point above aligned straight conductor segments. In addition, alignment of the raised feed point with an extended antenna segment extending from a folded conductor portion positions the feed point and the extended segment of the antenna at a concealed area of the window lite. In addition, the present invention provides a lengthened antenna conductor with improved gain over a wide bandwidth, where portions, such as a fold formed by a segment aligned with an edge panel portion of the vehicle body, are aligned in relationships with adjacent structures including the conductor structures of the window lite.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which.

DETAILED DESCRIPTION OF PREFERRED EMBODIMENT

Figure 1:
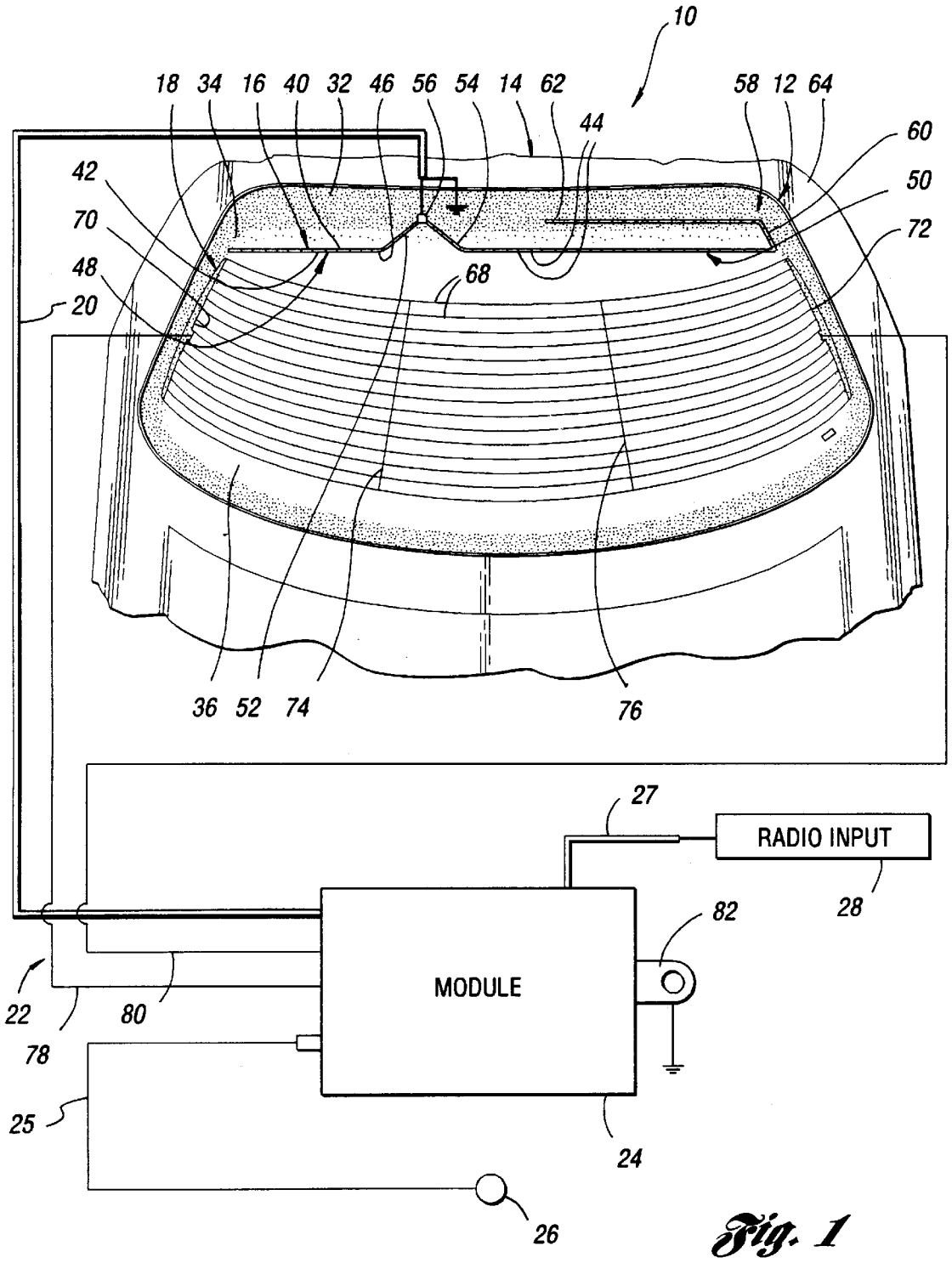
FIG. 1 is a fragmentary perspective view of a motor vehicle window light area carrying antenna conductors constructed in accordance with the present invention and schematically coupled.

Referring first to FIG. 1, an antenna system 10 for a window lite 12 for a motor vehicle 14 includes an FM signal antenna conductor 16 and a heater grid 18 that also serves as an AM antenna. Both of the antenna conductors 16 and 18 are electrically coupled by cables 20 and 22, respectively, to an antenna module 24 providing power to the heater grid from a power source 26 such as the vehicle battery. In addition, the module 24 receives the voltage signals received by the antenna 16 and the grid 18 for delivery to the radio receiver 28 mounted in the motor vehicle 14.

The window lite 12, made of glass or laminated layers includes a shaded, painted or screen printed blackened area 30 at the peripheral rim 32 of the window lite. In addition, a transitional shading area 34 such as a dot matrix screen printed pattern separates the upper portion of the shaded area 30 from the clear window portion 36. The heater grid 18 is positioned throughout a large portion of the central clear area 36, while the FM antenna 16 is positioned near the edge of the central clear area 36, and may be wholly or partly concealed at the areas 30 or 34. Although the window glass 12 is shown as a back lite in the preferred embodiment, it is to be understood that the antenna structures are applicable to any window lite vehicle panels formed of an insulating material.

The antenna 16 comprises a first conductor strand 40 aligned parallel to a second conductor strand 42. The parallel strands 40 and 42 are spaced apart about 4 mm. preferably in the range of 4 mm. to 8 mm., connected by cross member conductor segments 44 connected across the parallel conductors 40 and 42 at a plurality of spaced positions along the length of the conductor. The conductor strands are preferably screen printed about with a width of about 0.6 mm. to 1 mm. Spacing between the cross members 44 may be varied so as long as the spacing is substantially less than a wavelength within the bandwidth of the signals to be received. Nevertheless, it will be understood that the ladder construction may be without particular regard to the shape of the conductors, although it is preferred that the conductors are printed on the window lite as by known screen printing processes, to form the ladder structure of the preferred embodiment, and will have perpendicular conductor segments about the size of the conductors 40 and 42 in order to maximize the open area in the spaces between the conductors. In the preferred embodiment, the antenna 16 has a length of about ½ λ of the highest frequency of the bandwidth.

The antenna 16 has a first straight line segment 48 and a second straight line segment 50 extending at a position immediately below the partially shaded area 34. The close juxtapositioning of these antenna segments near the dot matrix area 34 minimizes its prominence on the back lite 12.

Each straight line segment 48 and 50 is coupled by inclined feed segments 52 and 54 that are joined at a feed point 56. The position of the feed point 56 along the length of the conductors forming the antenna 16 is determined in accordance with the conventional practice to provide a desired level of impedance matching with the module 24 and the receiver system 28. In any event, it will be understood that the inclination of the back lite 12 provides some vertical height to the feed point above the straight conductor segments 48 and 50. This raised feed point structure contributes to improved gain performance. In any event, the feed point 56 that connects the antenna 16 to the cable 20 may be obscured beneath the blackened window lite area 32 for concealment.

In addition, the antenna 16 has a length substantially longer than the transverse dimension of the back lite 12, and therefore includes a fold 58. The fold includes a conductor segment 60 that leads to an extended conductor portion 62. Preferably, the extended conductor segment 62 is aligned parallel to and overlapping the straight line segment 50 and is preferably positioned at the height of the feed point 56 over the straight line segments 48 and 50. Moreover, the conductor segment 60 at the fold is preferably aligned with the edge of the back lite 12, the edge substantially matching the angle of inclination of the side surface edge 64 of the motor vehicle body, to further improve performance of the antenna 16.

Still referring to FIG. 1, a heater grid 18 includes a plurality of transverse conductors 68 extending transversely between common potential conductors 70 and 72. In addition, the heater grid preferably avoids resonances that interfere with the FM antenna reception by including equipotential conductor lines 74 and 76. In accordance with the preferred embodiment of the present invention, each equipotential line conductor crosses each transverse conductor 68 at a point of constant electrical potential between the positive and negative common potential conductors 70 and 72 respectively. Moreover, the end of the equipotential line conductor 74 is aligned with the feed point 56, while the equipotential line conductor 76 is aligned symmetrical to the equipotential line conductor 74 with respect to the center of the grid 18.

The common potential conductors 70 and 72 are coupled by respective conductors 78 and 80 of the cable 22 to the module 24. The module 24 is also mounted preferably in a concealed area within passenger compartment by a grounding lug 82, for fastening to a vehicle body panel that assures a common ground for the circuitry. In addition, the module includes an output from the antenna 16 and 18 through the cable 27 for introduction to the receiver 28. In addition, the power cable 25 couples the module 24 to the power source 26.

Figure 2:
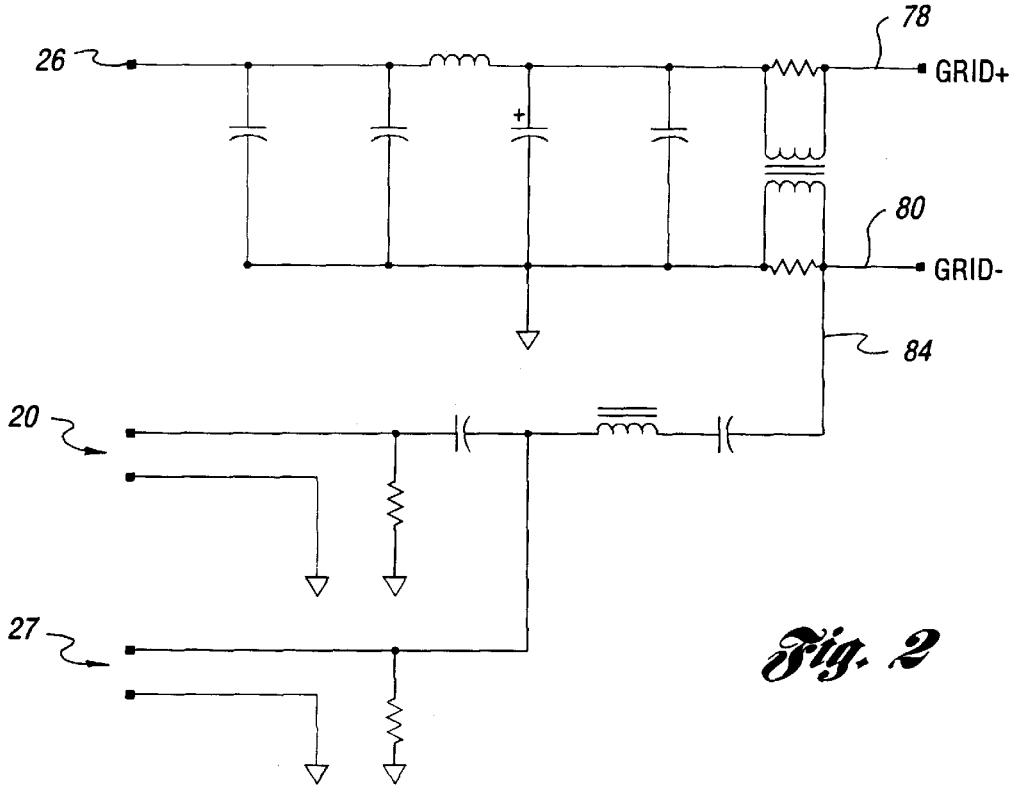
FIG. 2 is a schematic view of a module used to connect the antenna conductors to a receiver as shown in FIG. 1.

The features of the module 24 are best shown in FIG. 2 comprising a pot core transformer for separating the radio frequency signal from the DC of voltage applied to the grid for heating purposes. Both the cable 20 and the radio frequency signal line 84 are introduced to the cable 27 through a combiner filter that combines the AM and FM signals as one to be accepted by the receiver 28.

Figure 3:
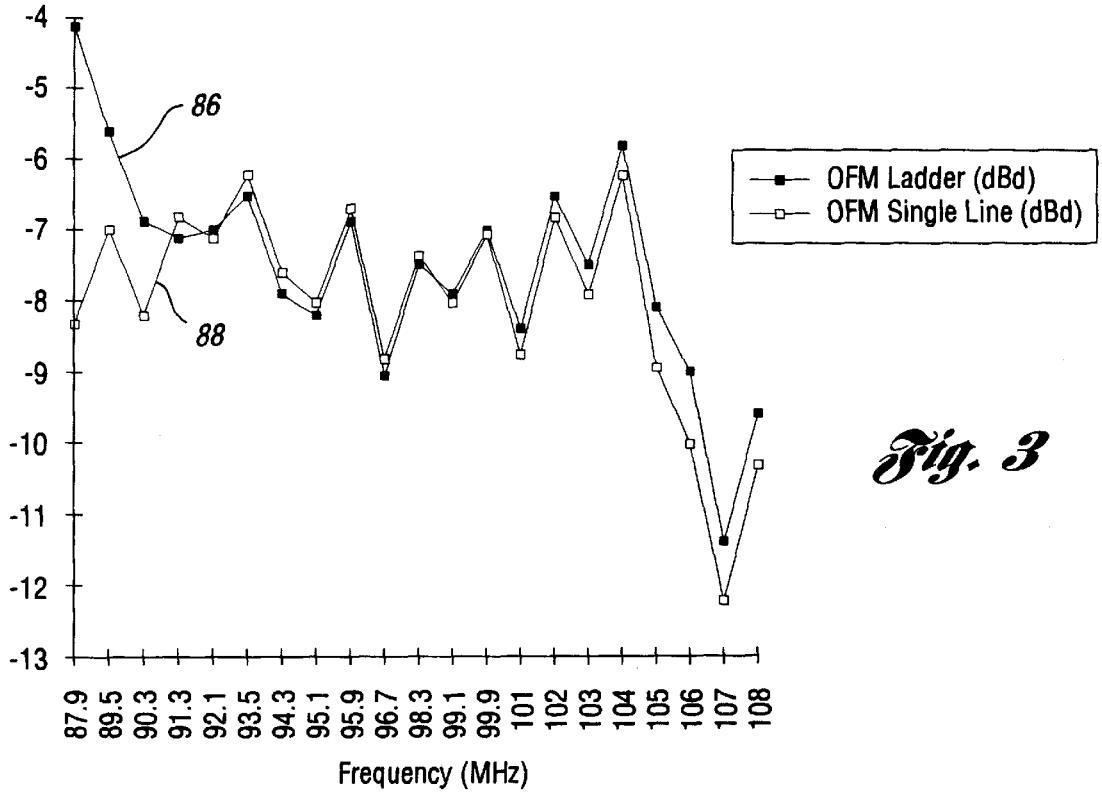
FIG. 3 is a graphical representation of the improved signal reception over a desired bandwidth for a system constructed in accordance with FIG. 1.

Referring now to FIG. 3, a plotted line 86 demonstrates improved performance of the window lite antenna construction according to FIG. 1 in reference to the performance of a dipole in comparison with a plotted line 88 obtained from a single conductor antenna arrangement also in reference to the performance of a dipole. Preferably, the reference antenna is very near the ideal dipole antenna mounted on a turntable in a nonobstructed area for reception of radio wave signals transmitted to the receiver in a motor vehicle to which the reference antenna is mounted. A standard test reference is useful for comparing the performance of new antenna designs.

Plotted line 86 depicts improved performance over the reference antenna plotted line 88 at the upper and lower ends of the bandwidth. The most significant difference in performance demonstrates at the lower end of the bandwidth shows a substantial increase at the end of the radio frequency band over the reference antenna, at the far left of the graph in FIG. 3. Smaller but relatively consistent improvement at the upper end of the frequency range will be noted on the right hand portion of the plotted line shown in FIG. 3.

Having thus described my invention, many modifications thereto will become apparent to those skilled in the art to which it pertains without departing from the scope and spirit of the present invention as defined in the appended claims.

What is claimed is:

1. An antenna for receiving FM radio signal in a vehicle comprising:

an elongated monopole conductor aligned generally transversely across a window lite, and having a fold at an end, and having a feed point at which a cable electrically couples said monopole conductor for introduction to a receiver, and a heater grid comprising a plurality of transverse conductors coupled at each end by first and second common potential conductors, respectively, said grid having an equipotential conductor intermediate said first and second common potential conductors and connected to said transverse conductors, wherein said equipotential conductor is aligned toward and conductively independent of said feed point.

2. The invention as defined in claim 1 wherein said equipotential conductor is offset from the center of said grid.

3. The invention as defined in claim 2 and further comprising a second equipotential conductor immediate the first and second common potential conductor in a symmetrical alignment to said equipotential conductor with respect to the center of said grid.

4. The invention as defined in claim 1 wherein said elongated monopole conductor comprises two straight line portions and an intermediate raised portion containing said feed point.

5. The invention as defined in claim 4 wherein said raised portion includes conductor portions angularly aligned with respect to said straight portions.

6. The invention as defined in claim 1 wherein said monopole conductor comprises a perforated strip.

7. The invention as defined in claim 6 wherein said conductor comprises a ladder.

8. The invention as defined in claim 1 wherein said fold includes a monopole conductor portion aligned to correspond with an adjacent vehicle body panel edge.

9. An antenna for receiving a radio signal within a predetermined bandwidth in a vehicle comprising:

an elongated strip conductor aligned on or in a window lite, and mounted thereon for electrical connection with a cable at a feed point for introduction of a signal to a receiver;

wherein said elongated strip conductor consists of a first conductor strand, a second conductor strand parallel to the first conductor strand, and conductor segments connected across the first and second conductor strands at positions spaced substantially less than a wavelength of the highest frequency to be received in the bandwidth, wherein the length of each conductor segment is substantially less than the length of said elongated strip conductor.

10. The invention as defined in claim 9 wherein said elongated strip conductor comprises a ladder.

11. The invention as defined in claim 10 wherein said conductor segments are strands.

12. The invention as defined in claim 11 wherein said conductor segment strands are parallel.

13. The invention as defined in claim 9 wherein said conductor segment strands are perpendicular to said first and second strands.

14. The invention as defined in claim 9 wherein said elongated strip conductor includes a fold.

15. The invention as defined in claim 14 wherein said fold includes an elongated strip conductor portion aligned to correspond with an adjacent vehicle body panel edge.

16. The invention as defined in claim 9 wherein said elongated strip conductor is aligned generally transversely across the window lite, said conductor having a ladder construction, said conductor having a feed point intermediate its ends at which a cable couples said elongated strip conductor to a receiver, said conductor having a fold at one transverse end, and said fold comprising two straight line portions and an intermediate raised portion.

17. The invention as defined in claim 16 wherein at least one portion of said fold is aligned to correspond with an adjacent vehicle body panel edge.

18. An antenna for receiving a radio signal within a predetermined bandwidth in a vehicle comprising:

an elongated strip conductor aligned on or in a window lite, and mounted thereon for electrical connection with a cable at a feed point for introduction of a signal to a receiver;

wherein said elongated strip conductor consists of a first conductor strand, a second conductor strand parallel to the first conductor strand, and conductor segments connected across the first and second conductor strands at positions spaced substantially less than a wavelength of the highest frequency to be received in the bandwidth; and wherein said elongated monopole conductor comprises two straight line portions and an intermediate raised portion containing said feed point.

19. The invention as defined in claim 18 wherein said window lite includes a heating grid having an equipotential conductor and said equipotential conductor is aligned with said feed point.

20. The invention as defined in claim 19 wherein said feed point is conductively independent of said equipotential conductor.

* * * * *